United States Patent [19]

Bocckino et al.

[11] Patent Number: 4,479,790

[45] Date of Patent: Oct. 30, 1984

[54] CENTRIFUGAL SEPARATOR AND METHOD OF OPERATING SAME

[75] Inventors: Harry G. Bocckino, Fairfield, Conn.; Jon P. Meyer, Golden, Colo.

[73] Assignee: Texasgulf, Inc., Stamford, Conn.

[21] Appl. No.: 487,725

[22] Filed: Apr. 22, 1983

[51] Int. Cl.[3] ..... B04B 1/00

[52] U.S. Cl. ..... 494/85; 494/56; 494/75; 210/512.3

[58] Field of Search ..... 494/85, 56, 59, 43, 494/69, 74, 75, 66, 67, 68, 76; 422/72; 210/512.1, 512.2, 512.3, 304

[56] References Cited

U.S. PATENT DOCUMENTS

| | | | |
|---|---|---|---|
| 1,124,907 | 1/1915 | Jahn | 494/56 |
| 1,208,960 | 12/1916 | Hedderich | 494/75 |
| 1,634,759 | 7/1927 | Sharples | 494/75 |
| 4,279,741 | 7/1981 | Campbell | 494/36 |

OTHER PUBLICATIONS

Centrifugal Separator for Beneficiation of Wolframite Slimes, Nonferrous Met. (China), 1980, 32, (4), 33–35, Authors, C. Orien and X. Jiazji.

The Use of Centrifugal Separators in the Separation of Tin Ore Slimes, Nonferrous Metals, vol. 33, No. 1, Feb. 1981, pp. 36–38.

*Primary Examiner*—Robert W. Jenkins

*Attorney, Agent, or Firm*—Bell, Seltzer, Park & Gibson

[57] ABSTRACT

A continuous flow device for separation of particles of differing densities in a centrifugal force field. Very small particles of differing densities that are normally very difficult or impossible to separate in the useful commercial gravity separation devices can be separated because of the increased settling force due to the centrifugal force field and also the buoyant force on the particles of lesser density caused by a thickened slurry layer. A thin film of a slurry of solid particles of differing size and density travels over a revolving surface of such configuration that the slurry flows in a substantially laminar manner. As the thin film of slurry flows along the surface, the particles of greater density tend to concentrate in the region next to the surface. While the particles of lesser density remain in or are forced into the fraction of the film closest to the axis of revolution. Before the film of slurry reaches the end of the flow path it is passed over a splitting device to separate the fraction of the film containing particles of greater density from the fraction containing particles of lesser density.

20 Claims, 6 Drawing Figures

CENTRIFUGAL SEPARATOR AND METHOD OF OPERATING SAME

TECHNICAL FIELD

The present invention relates to recovery by centrifugal separation of heavy minerals (e.g., rutile, cassiterite, wolframite, scheelite, galena, silver, gold, and platinum group metals) from less dense materials. Conversely, the present invention could be used to recover or eliminate light minerals from more dense materials. Such applications include the recovery of valuable minerals from the tailing piles of previous gravity separation operations and separation of ore deposits which would otherwise not be considered economically treatable because of the fineness of the mineral fraction to be recovered.

BACKGROUND ART

Most commonly, the current practice is to separate minerals of different density by gravity separation. Typical equipment used in the gravity separation operation includes jigs, shaking tables, sluices, spirals, and Reichert cones. However, gravity separation has a marked disadvantage. When the size of the particles to be separated out falls below 50 microns, gravity separation equipment either loses collection efficiency or has very low throughput rates. The former result renders the equipment useless; the latter result renders it more costly or expensive to operate.

The Reichert cone concentrator is a high-capacity gravity separator incorporating multiple stages of flowing film concentration that has found application in areas of mineral processing where the materials have different specific gravities. This concentrator operates by feeding slurry onto a first curved conical surface in an annular distribution pattern. The dispersed slurry flows naturally to the outside edge of the cone surface, then changes direction and moves inward along a concentrating cone surface. As the slurry gravitates toward the center of the concentrating surface, the bed thickens due to the progressively smaller area available. The finer, heavier particles gravitate to the cone surface by a combination of interstitial trickling and normal settling mechanisms under the influence of gravity. Under controlled flow conditions, a large proportion of the heavier particles tend to remain in the lower layers of the moving bed of slurry, close to the cone surface. The stratified layers are then separated by an annular slot. Dilution water is provided via an annular water ring.

The drawback of the Reichert cone concentrator is the numerous stages required for a high-concentration assembly. Also, a typical cone system only enables efficient recovery of particles greater than 40–50 microns in size.

As a result of the deficiencies of such gravity separators, centrifugal separators have been adapted for use in the processing of ore. The Yunnan Tin Mining Company in China reports the development of a batch-type centrifugal separator for separation of cassiterite particles. Recoveries reported were 75–90% for plus 10 micron particle and 35–40% for minus 10 micron particle. The throughput of one unit is reported to be 30–35 metric tons per day. This centrifugal separator has also been used in recovery of tungsten minerals. No detailed description of the equipment is known to applicant although it is reported to have shortcomings (e.g., excessive consumption of water and noncontinuous feed).

Several centrifugal jig devices have been developed which enhance concentration by means of gravity separation. These centrifugal jigs enable the separation of materials with relatively small specific gravity differences. Also, by negating the surface effects which mask differences in the specific gravities of tiny particles, the centrifugal jigs allow gravity concentration to be applied to smaller particle sizes.

A continuous-flow centrifugal jig or concentrator marketed by the Indeco Company comprises a rotating cylindrical jig bed and a system for pulsed injection of liquid. This unit is described in U.S. Pat. No. 4,279,741. In comparison to a conventional mineral jig which is essentially a combination of two types of gravity separation systems (the rising current classifier operating by pulsation of liquid in opposition to settling forces and the heavy media separator obtaining separation of particles with different specific gravities), the system disclosed in U.S. Pat. No. 4,279,741 enhances the operation of a mineral jig by providing for centrifugally forced settling of particles by rotation of an even, layered jig bed. The combination of centrifugally forced settling and positive pulsation of liquid is utilized in the area of the jig bed to separate pulp into a heavy and a light fraction. The main drawback of this concentrator is that it is a sophisticated and complicated unit that requires time-consuming setup and stringent control procedures. Also, because of the nature of the process, feed must be very carefully classified ahead of the concentrator. Therefore, the operation of the concentrator is further complicated by the use of an interdependent classifier specifically adapted to the strict requirements of the concentrator.

The hydrostatic separator made by Knelson also operates according to the principles of centrifugation, but is not a jig. Essentially this unit comprises a high-speed ribbed rotating conic bowl with a drive unit. Feed material is fed into the spinning bowl. Under the influence of centrifugal force, concentrates collect in the ring-divided zones on the periphery of the bowl while the lighter tailings are spun upward along the slope of the bowl and overflow the rim. The unique aspect of this centrifugal concentrator is that a flow of water is injected through graduated perforations in the bowl wall. The injected water fluidizes the trapped concentrate, preventing compaction, which allows the bowl to be rotated at a much fastener rate. Thus, higher centrifugal forces are produced which enable even very fine particles of gold to be separated. The concentrate is collected in the bowl and emptied once a day. Thus, this separator is specifically designed to recover rare heavy particles such as gold and has little use as a continuous separator of light and heavy fractions because of the limited storage capacity for the heavy fraction and the excessive delay which would attend frequent stoppages for draining the concentrate.

The Tobie centrifugal concentrator is used by Koapsche Diggings in Transvaal for recovery of gold from gravel by gravity separation. Feed water are supplied to a drum rotating at 84 rpm. Float discharge in the rotating drum advances down the sloping drum and is discharged by means of internal lifters. The principle of operation is that gold particles are dense enough to be held against the wall of the drum by centrifugal force while the less dense material in the water passes through the system. At the end of the workday, the gold is removed from the drum. As was the case with the Knelson hydrostatic separator, due to the limited capacity of the drum, continuous flow separation of light and heavy fractions would not be practical with the Tobie centrifugal concentrator if the heavy fraction being concentrated was not highly dense and highly valuable.

Continuous-flow imperforate basket centrifuges can be used for classification by size. In this type of centrifuge, a helical conveyor moves the centrifuged solids along the inside surface toward the smaller diameter of a spinning frustum of a cone. However, the conveyor moving through the solids tends to mix them and prevent separation into laminae of particles according to density. This drawback makes such a centrifuge inefficient for the separation of light and heavy fractions.

Finally, the ultracentrifuge is a laboratory tool typically used for separating colloids and polymers of varying size and density. The unit operates with high centrifugal force, low percentage of solids, and in a particle size range smaller than that separated by the centrifugal separator of the present invention. Because the throughput rate of an ultracentrifuge is small, it has no applicability for commercial recovery of minerals.

DISCLOSURE OF INVENTION

The present invention is a continuous-flow device for separation of particles of differing densities under the influence of centrifugal forces. Very small particles of differing densities, which are normally very difficult or impossible to separate in commercial devices, can be separated by the present invention because of the increased settling force in the inventive centrifugal system and also because of the buoyant force on the lower-density particles caused by a thickened slurry layer of high density particles.

A thin film of a slurry of solid particles of differing size and density is transported relative to a revolving surface that is configured so as to ensure that the flow of the slurry is substantially laminar. The surface is rotated about an axis so that the centrifugal force presses the solid particles toward the surface, while the configuration of the surface is such that the component of the centrifugal force parallel to the surface pushes the slurry toward the discharge end of the device. The centrifugal force exerted causes particles of greater density to be transported radially through the liquid at average velocity greater than the velocity of the particles of lesser density. Due to these differential velocities, particles of greater density will travel further than particles of less density during a span of time. Operation is enhanced, in spite of the high throughput rate, by a long flow path and, an accordingly extended slurry transit time through the separator. As the film of slurry flows along the surface, particles of lesser density remain in or migrate into the fraction of film closest to the axis of revolution. Thus, the particles are separated into laminae according to their density. By separating the laminae from each other during the flow of the slurry, light and heavy fractions of particles can be separated.

The centrifugal separator according to the present invention has none of the above-mentioned disadvantages of the prior art. It is a simple and reliable apparatus that can be operated without time-consuming setup and stringent monitoring. It discharges the fractions continuously, thereby avoiding the losses which attend downtime of equipment. It separates light and heavy fractions with high throughput rates so as to make the device attractive for use in the commercial recovery of minerals. It is compact and easily transported. Finally, the enhanced settling attributable to the centrifugal force and extended slurry transit time through the separator allows fine particles to be separated which could not be separated by means of conventional separation.

BRIEF DESCRIPTION OF DRAWINGS

One way of carrying out the invention is described in detail below with reference to the drawings which illustrate only several specific embodiments of the invention, in which.

BEST MODE FOR CARRYING OUT THE INVENTION

Figure 1:
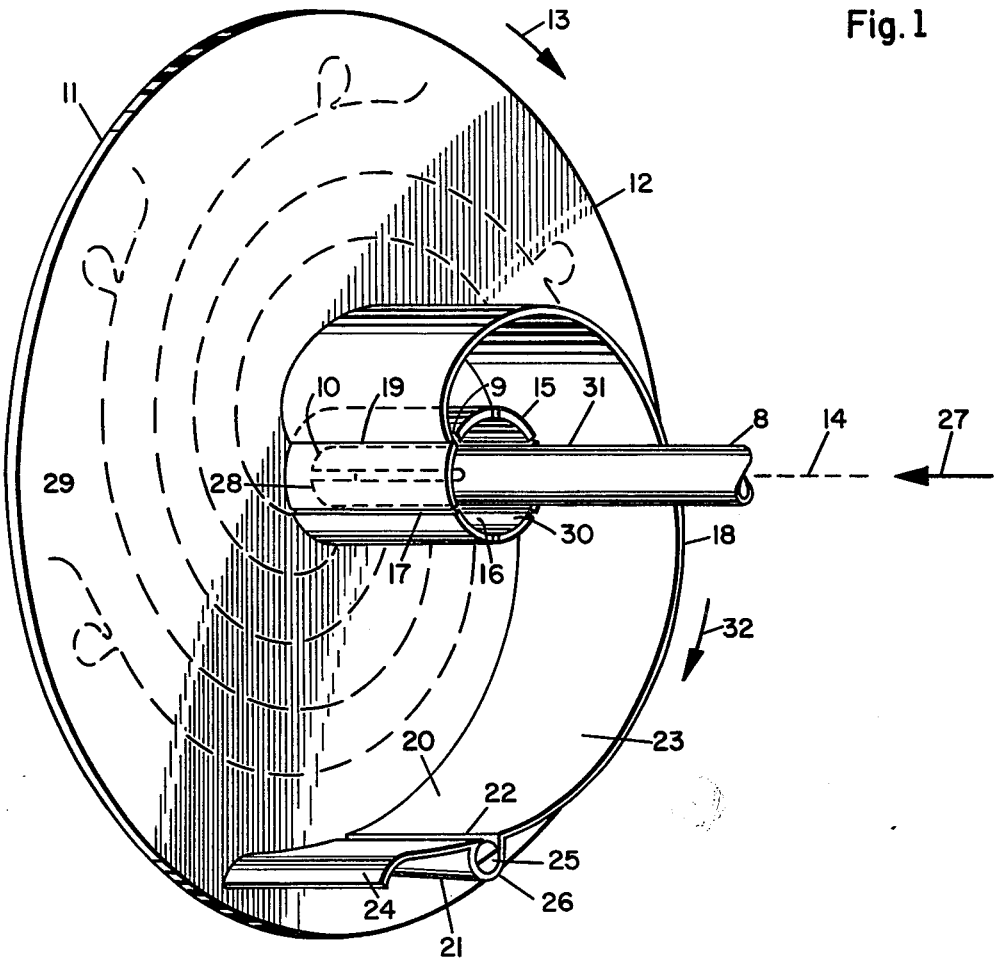
FIG. 1 is a schematic perspective view of the principal elements of the inventive separator with right cover plate removed.

Referring to FIG. 1, the inventive separator comprises a feed tube 8 which includes one or more elongated feed slots 9. The end 10 of feed tube 8 extends into the separating portion 11 of the apparatus but is mechanically independent thereof.

The principal parts of the separating portion 11 comprise a rotary support table 12 which is mounted for rotation in the direction indicated by an arrow 13 around an axis of rotation 14 indicated by phantom line. A splitter ring assembly 15 comprising deflecting surfaces 16 is secured to rotary support table 12. Deflecting surfaces 16 define elongated nozzles 17. There is one deflecting surface 16 and one nozzle 17 for each separator blade 18.

The separator blade 18 is secured to one end of each of the deflecting surfaces 16 along a respective seam 19 to define a guide surface 20 for receiving and guiding material which has passed through the system. While only one separator blade 18 is illustrated, the positions of the other separator blades are indicated in phantom lines. Each of the six separator blades 18 of the embodiment are secured to rotary support table 12. In addition, the joint between rotary support table 12 and each of the blades 18 is complete and continuous whereby no material may escape between this joint. Likewise, seam 19 between deflecting surfaces 16 and their respective blades 18 is also complete and continuous, thus insuring that no material will migrate through this seam.

The peripheral end of each of separator blades 18 includes a heavy fraction removing mechanism 21. In accordance with the embodiment illustrated in FIG. 1, this heavy fraction removing mechanism is located at slot 22 defined between an intermediate portion 23 and a peripheral portion 24 of the blade 18. Slot 22 works in conjunction with a tapered helical conveyor 25 contained within the conveyor housing 26.

During operation, slurry to be separated flows through feed the 8 in the direction indicated by an arrow 27, being fed therethrough under pressure. As the slurry containing heavier and lighter fractions is emitted through feed slot 9, and to a limited extent through a small gap between the end 28 of feed tube 8 and a surface 29 of rotary support table 12, slurry is caused to accumulate in the chamber defined between surface 29, the right cover plate not shown, the inner surfaces of deflecting surfaces 16 and the outer surface 31 of feed tube 8.

As the slurry to be separated accumulates in the chamber, it bears against side surface 29, inner surfaces 30, and the top cover plate. As it bears against the surfaces, table 12 is caused to rotate, thus subjecting the slurry to centrifugal forces which tend to drive it from the chamber through the elongated nozzles 17 from which, under the influence of the centrifugal forces caused by rotation of table 12, the slurry is caused to migrate inside guide surfaces 20 of blades 18.

As discussed above, under the influence of the centrifugal forces imparted by rotation of the table 12, the slurry progresses toward the periphery of the system, and is caused to bear against surface 20. Surface 20 is configured in such a manner that rotation in the direction indicated by arrow 13 results in urging the slurry against surface 20.

As the slurry progresses along surface 20 in the direction indicated by arrows 32, it is subjected to centrifugal forces, thus causing the heavier components of the slurry to migrate toward the surface 20, and become concentrated there in a laminar flow stratified with heavier and heavier fractions concentrating laminae near surface 20. As migration of the slurry proceeds from points adjacent the elongated nozzles 17 to points closer to slot 22, the process duration and G forces are increased due to the shape of the blades 18. Increased stratification and concentration of heavier materials closer to surface 20 will then occur as a result of this increased process duration. When the slurry passes over slot 23 the heaviest fractions of the slurry tend to pass through slot 22 and are removed by helical conveyor 25. The remaining lighter components of the slurry then pass to peripheral portion 24 of blade 18 from which they exit the system.

An appreciation of the advantages of the above described system will be achieved by considering, for comparison purposes, the operation of a gravity type system where, under the influence of gravity, a particle suspended in a less dense medium will migrate in a downward direction. Sedimentation of a particle may depend on size, mass, shape and density of the particle as well as the density and viscosity of the suspending medium. In many potentially commercially valuable situations, no sedimentation will be observed under the influence of gravity, or the sedimentation rate may be too slow for industrial purposes. In accordance with the present invention, the sedimentation rate of particles in such a slurry is accelerated by subjecting the slurry to a centrifugal force field stronger than gravity.

In addition to increasing the separation rate, the degree of separation is also increased in a centrifugal system constructed in accordance with the present invention. In particular, it is noted that relatively fine solids cannot be separated from a fluid by gravitational phenomena. When the separating force is enhanced, the mixing phenomena become negligible in comparison to the forces of the centrifuge system, therefore facilitating more efficient and rapid separation.

The present invention utilizes the separating effect of the centrifugal force to advantage by providing a continuous-flow device which separates particles of differing densities in a centrifugal force field. In addition, the use of centrifugation also results in a slurry layer selectively thickened in radially external laminae, which contain the heavier particles. This has the additional favorable effect of exerting an enhanced buoyant force on particles of lesser density counter to the direction of settlement, thus increasing the degree of stratification.

Figure 2:
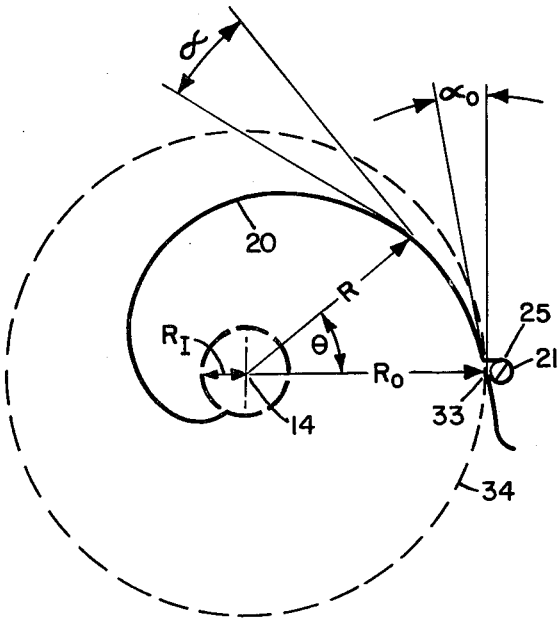
FIG. 2 is a top plan view of the apparatus of FIG. 1, illustrating a graphical representation of a preferred shape for a flow deflecting surface in an apparatus constructed in accordance with the present invention.

A preferred geometric profile for guide surfaces 20 such as that illustrated in FIG. 1 is shown schematically in FIG. 2. The profile of the curved surface is designed to produce a constant velocity throughout the entire flow path, also to cause the slurry, flowing in a film on surface 20 to flow in a laminar manner. With reference to FIG. 2 this highly desirable characteristic can be achieved by shaping the guide surface 20 according to the equation;

$$\theta = \mathrm{ctn}\,\alpha_o - [(R^2 - \sin^2 \alpha_o)^{\frac{1}{2}}/(\sin \alpha_o)] - \pi/2 + \alpha_o + \cos^{-1}[(\sin \alpha_o)/R]$$

Where $\theta$ is the angle between a ray to a point on the surface 20 and the ray from the axis of rotation to a point 33 which corresponds to the position of slot 22, where slurry fractions are divided; R is the length of the ray from the axis of rotation to the respective point on surface 20; and $\alpha_o$ is the angle between the tangent to the circle 34 of radius $R_o$ at slurry split point 33 and the tangent to surface 20 at the slurry split point. It will be noted that:

$$R_I = R_o \sin \alpha_o$$

Where $R_I$ is the length of the ray from the axis of rotation to surface 16, and $R_o$ is the length of the ray from the axis of rotation to the slurry split point 33. Based on geometrical principles, it can be shown that:

$$R \sin \alpha = R_o \sin \alpha_o$$

Where $\alpha$ is the angle between the tangent to a circle of radius R and the tangent to the surface 20 at a point on the surface a distance R from the axis of rotation 14. In the above equations, all angles are expressed in radians and the radial distance R to the flow deflecting surfaces 20 are expressed as a fraction of the radial distance $R_o$.

Figure 3:
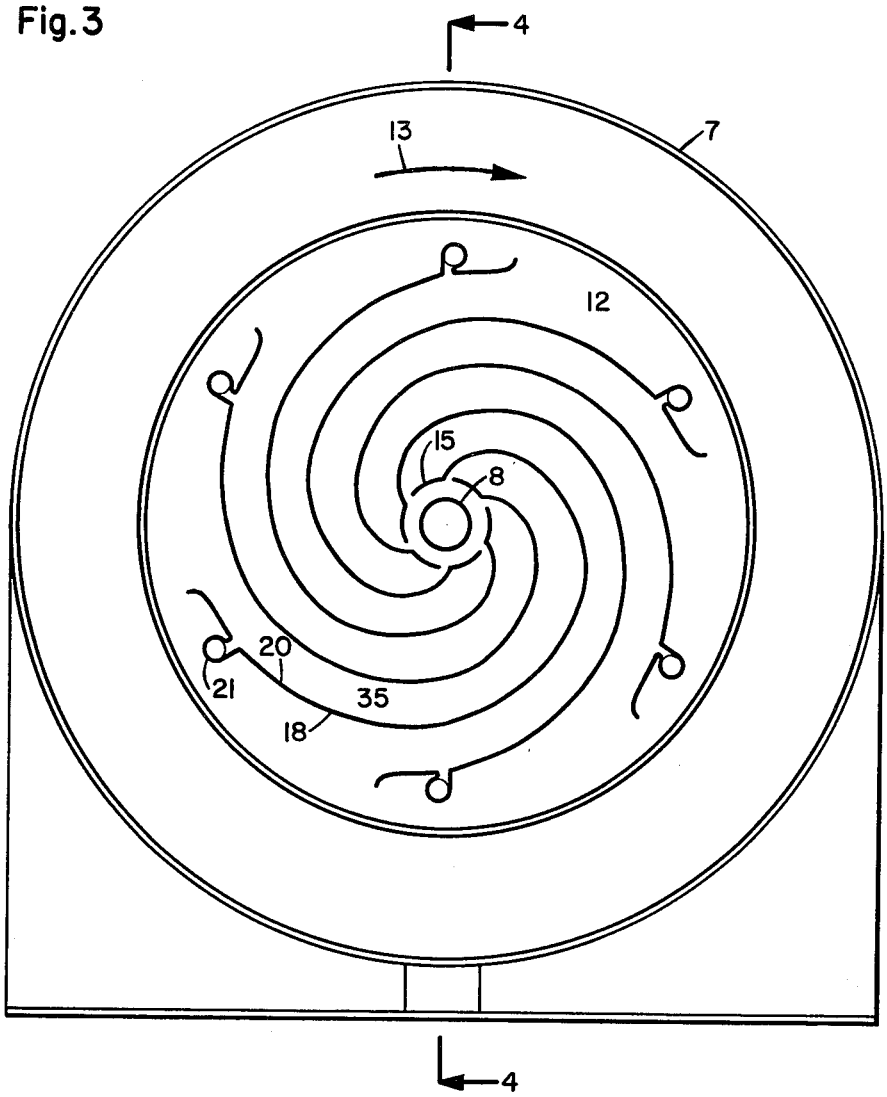
FIG. 3 is a side plan view, partially in cross section, of the inventive separator.
Figure 4:
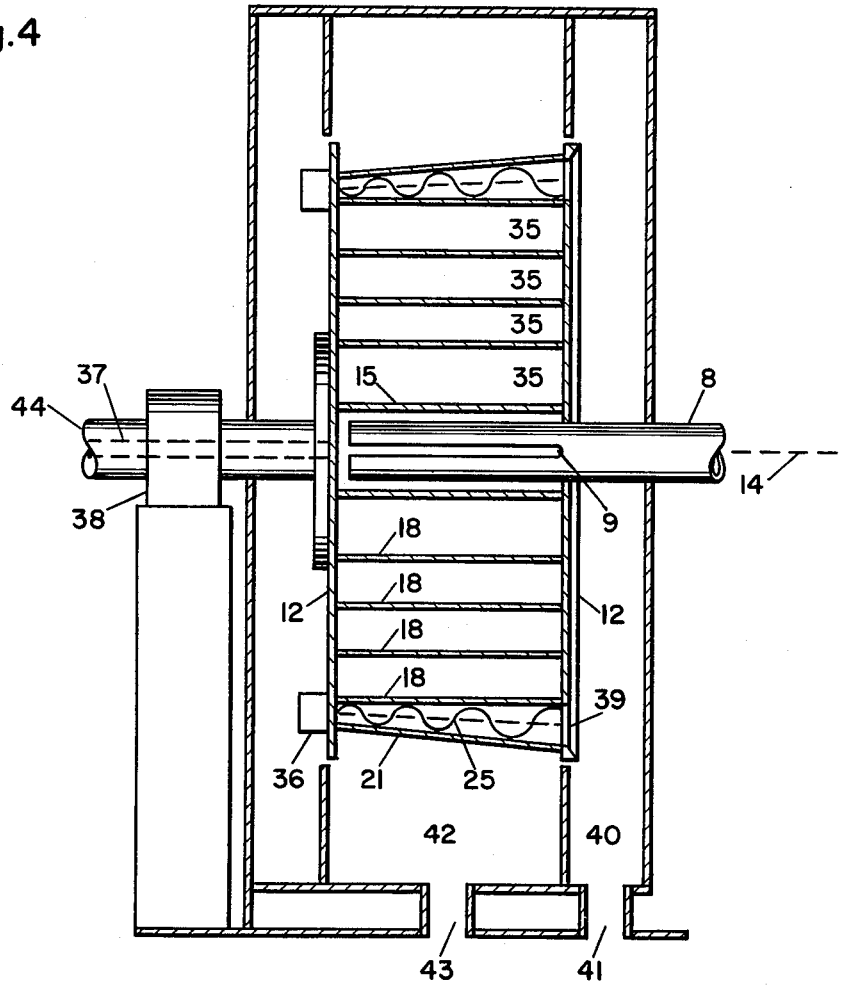
FIG. 4 is a sectional view of a preferred embodiment of the inventive separator taken along lines 4—4 of FIG. 3.

A more complete description of the inventive apparatus is illustrated in FIGS. 3 and 4. The principal operating elements operate in substantially the same manner as the embodiment shown in FIG. 1 and, for simplicity of explanation, are given the same numbers as used in connection with the description of FIG. 1. In particular, the inventive apparatus constructed in accordance with FIGS. 3 and 4 comprises a feed tube 8 which feeds a splitter ring assembly 15, which is coupled to a plurality of separator blades 18. Associated with each of the separator blades is a heavy fraction removal mechanism 21 situated at the outer portion of the blade.

As illustrated in FIGS. 3 and 4, the inventive separator is oriented in the vertical direction. As shown most clearly in FIG. 4, separator blades 18 are secured between a pair of facing rotary support tables 12. This results in defining chambers 35 between adjacent blades. Heavier fractions of the slurry are removed from surfaces 20 of blades 18 by heavy fraction removal mechanisms 21 which operate using a helical conveyor mechanism as described above. These helical conveyors 25 are driven by a plurality of hydraulic motors 36, as illustrated most clearly in FIG. 4. Motors 36 are driven at the same speed so that they remove the same fraction of heavier components uniformly. Motors 36 are driven by a hydraulic fluid which is furnished through hydraulic tubes 37 contained within rotary mounting supports 38, which is the support for rotating shaft 44, to which the assembly comprising tables 12, splitter blades 18, and associated parts of the system are mounted for rotation.

The outputs 39 of the removal mechanisms 21 are in communication with a chamber 40 defined within the apparatus. In turn, chamber 40 is in communication with heavy fraction outlet 41.

In similar fashion, light fraction not removed by removal mechanisms 21 are in communication with annular chamber 42, which in turn is in communication with light fraction outlets 43.

As was discussed above in connection with FIG. 1, slurry enters feed tube 8, passes through the slots 17 in the splitter ring assembly 15 onto surfaces 20, and has its heavy fractions removed by heavy fraction removal mechanisms 21 which feed the material into chamber 40. Lighter fractions continue along surface 20 from which they are discharged into chamber 42.

As material collects and falls to the bottom of chamber 40, it is removed by gravity or suction through a heavy fraction outlet tube 41. Likewise, lighter fractions collect at the bottom of chamber 42 for removal through outlet 43.

Under actual operating conditions, a thick slurry containing 40–75% solid particles is fed to the device at a rate in the range of 2–10 tons per hour per meter for each surface. Thus, for a rotor having six flow deflecting surfaces of 0.6 meter width, the throughput rate would be 170–900 tons per day. Typically, such a system would have a rotor size in the range of 1 to 2 meters in diameter.

Figure 5:
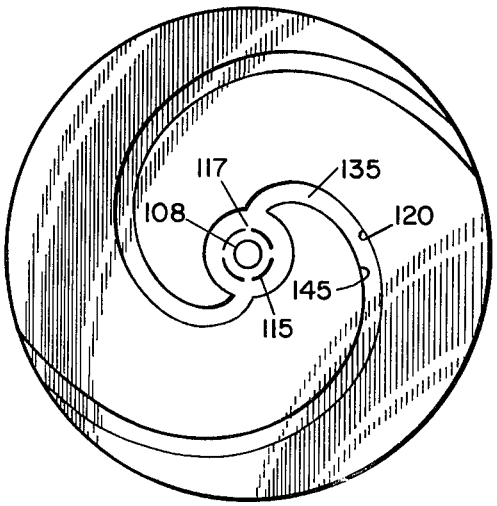
FIG. 5 is a side plan view of an alternative embodiment of the invention.

Referring to FIG. 5 an alternative embodiment of the invention is illustrated. This apparatus operates in a manner substantially similar to that of the system of FIGS. 1–4. For purposes of clarity, corresponding elements in the embodiment of FIG. 5 are assigned reference numerals 100 higher than corresponding elements in the embodiment of FIGS. 1–4.

Generally, the system comprises a feed tube 108 which feeds a splitter ring assembly 115. The splitter ring defines a multitude of elongated nozzles 117, which communicate with chambers 135 defined by confronting surfaces 120 and 145. The pairing of surfaces 120 and 145 form a slot between surfaces. It will be noted that the dimension of the slot formed by surfaces 120 and 145 is not critical, since the slurry film transported along surface 120 is very thin.

In contrast to the embodiments illustrated in FIGS. 1–4, the system illustrated in FIG. 5 includes a different mechanisim for removing heavier fractions of the slurry as they are driven toward surface 120 during centrifugation.

As discussed above, the film of slurry reaching the end of the flow path defined by surface 120, must be processed by a splitting device to separate the fraction of the film containing particles of greater density from the fraction containing particles of lesser density. In particular, the flow of slurry across surface 120 is quite critical. Any heavy fraction removal mechanism must be such that it will not interrupt the laminar flow of the slurry. Were the slurry to flow in a turbulent, rather than a laminar manner, the resulting eddy flow would have a component normal to the flow-deflection surface 120, which would tend to mix rather than separate the particles of different density. Likewise, it is important that any mechanism for removing heavier fractions of the slurry insure that the slurry remain fluid during its travel along the flow-deflecting surface 120. If solid particles were to separate from the slurry and form a solid bed against the flow deflecting surface, the separation process of light and heavy fractions would cease.

Figure 6:
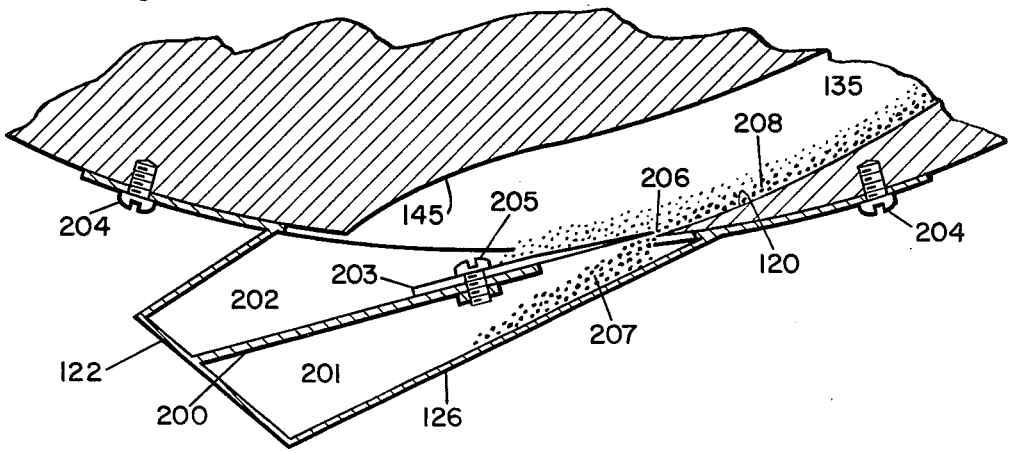
FIG. 6 is a side plan view of an alternative divider for removing heavy fractions shown in the environment of the embodiment of the apparatus of FIG. 5.

The above requirements are achieved by the heavy fraction removal mechanism 122 illustrated in FIG. 6. Removal mechanism 122 includes a housing 126 which defines chambers into which heavy and light fractions of slurry are discharged. In particular, a divider plate 200 separates a heavy fraction discharge chamber 201 from a light fraction discharge chamber 202. The plate 200 prevents commingling of the light and heavy fractions following separation. Housing 126 is secured over the opening defined by the ends of surfaces 120 and 145. Plate 200 is, in turn, secured to housing 126. Splitting is performed by a splitter blade 203, which is mounted on plate 200. Housing 126 is desirably secured to the system by a pair of screws 204, and splitter blade 203 is desirably secured to plate 200 by a screw 205. The use of screws 204 and 205 facilitates easy removal of the housing and splitter blade assembly, thus allowing the frequent replacement or sharpening of the splitter blade to assure top performance of the system. In addition, such an arrangement allows adjustment of gap 206 between splitter blade 203 and surface 120. Other means of separating would include a variable width gap.

During operation of the system illustrated in FIGS. 5 and 6, slurry enters feed tube 108 and is divided by splitter ring assembly 115 from which it is fed between surfaces 120 and 145. When the slurry progresses by laminar flow to the vicinity of heavy fraction removal mechanism 122, the heavier fraction 207 of material 208 situated closer to surface 120 pass through the gap between the tip of the blade 203 and surface 120, and into heavy fraction discharge chamber 201. The remaining portion of slurry 208 then passes over the top of the blade into chamber 202.

As discussed above, the profile of the flow-deflecting surface 20 shown in FIG. 2 is configured to keep the slurry flowing in a substantially laminar manner throughout the flow path. Thus the film thickness and average flow velocity will be substantially constant. The profile of surface 20 can be modified (flattened) to thicken the film prior to splitting, or made steeper to prevent the build-up of solids. The width of the surface 20 can also be designed so as to decrease the flow area in order to thicken the film prior to separation and discharge. The device would then be functioning as a pinched sluice operating under centrifugal rather than gravitational force.

It is also possible to make more than one separation along the flow path in order to separate concentrate (particles of greater density) and middling (particles of medium density) fractions. During typical operation, the force at the discharge end of guide surface 20 will be in the range of 50 to 200 times that exerted by gravity, depending on the angular velocity. The centrifugal force can be further increased as needed to separate finer particles, but this may cause increased wear on the equipment.

While illustrative embodiments of the invention have been described in connection with FIGS. 1 to 5, it is, of course, understood that various modifications obvious to those of ordinary skill in the art, may be made without departing from the spirit and scope of the invention, which is limited and defined only by the appended claims.

We claim:

1. An apparatus for separating heavy fractions from a material having heavy and light fractions, comprising;

(a) support means;

(b) rotary means for rotably supporting said support means about an axis of rotation;

(c) drive means for imparting a rotary motion to said support means;

(d) feed means introducing the material into the apparatus;

(e) centrifuging surface means extending from positions relatively close to said axis of rotation to positions progressively more removed radially from said axis of rotation, and configured and positioned to receive said material and to impart a rotary motion to said material and subject said material to centrifugal forces, said surface means being further configured to allow only a portion of said centrifugal force to advance said material to radial positions progressively more displaced from the axis of rotation of said support means, or subjecting said material to stratifying centrifugal forces as said material advances toward points on said centrifugal surface relatively more removed from said axis of rotation; and (f) separator means positioned near the radially outermost point on said centrifuging surface to remove said heavy fraction.

2. Apparatus as in claim 1, wherein centrifuging surface extends radially outward in a direction which makes an acute angle between the radius and the tangential component of the velocity vector of said material.

3. Apparatus as in claim 1, wherein said centrifuging surface means extends from said support means with a width which becomes progressively smaller as said centrifuging surface means extends toward positions radially more displaced from said axis of rotation.

4. Apparatus as in claim 1, wherein said stratifying centrifugal forces form said material into a film disposed against said centrifuging surface means, said film being divided into laminae and said centrifuging surface means being positioned and dimensioned to impart unequal velocities to different laminae in the direction of said centrifuging surface means.

5. Apparatus as in claim 4, wherein said centrifuging surface means is substantially as defined by the equation:

$$\theta = \mathrm{ctn}\alpha[(R^2 \sin^2 \alpha_o)^{\frac{1}{2}}/\sin \alpha_o] - \pi/2 + \alpha_o + \cos^{-1}[(\sin \alpha_o)/R]$$

Where $\theta$ is the angle between a ray from said axis of rotation to a given point on said centrifuging surface means and a ray from said axis of rotation to a second point adjacent to the position of said separator means; R is the length of said ray from said axis of rotation to said given point on said centrifuging surface means; and $\alpha_o$ is the angle between a tangent to a circle of radius $R_o$, where $R_o$ is the distance between said axis of rotation, and said second point, said circle of radius $R_o$ being centered on an axis of rotation and the tangent to said centrifuging surface means at said second point.

6. Apparatus as in claim 1, wherein said centrifuging surface means comprises a plurality of blades secured between a pair of confronting support surfaces and in sealing engagement therewith.

7. Apparatus as in claim 6, wherein said separator means comprises a doctoring blade.

8. Apparatus as in claim 6, wherein said separator means comprises a screw conveyor.

9. Apparatus as in claim 6, wherein said blades are fed by an annular multi-slotted feeder member concentric with said axis of rotation.

10. Apparatus as in claim 1, wherein said centrifuging surface is configured and dimensioned to cause substantially laminar flow of material along said centrifuging surface means toward positions progressively more removed radially from said axis of rotation.

11. Apparatus as in claim 10, wherein said separator means comprises a doctoring blade.

12. Apparatus as in claim 10, wherein said separator means comprises a screw conveyor.

13. Apparatus as in claim 10, wherein said blades are fed by an annular multi-slitted feeder member concentric with said axis of rotation.

14. Apparatus as in claim 1, wherein said centrifuging surface means is formed by an element disposed between said support means and a facing support means and in sealing engagement with said support means and said facing support means.

15. A centrifugal separator separating heavy and light slurry fractions from each other, comprising:

(a) a housing rotatable about an axis of rotation;

(b) stationary slurry intake means positioned along said axis of rotation;

(c) a slurry distribution ring rigidly fixed to and concentric with said housing and having at least two slots extending in the same direction as said axis of rotation;

(d) a number of separating surfaces, said separating surfaces being positioned, configured and dimensioned within said housing and lying parallel to said axis of rotation to define a plurality of chambers within said housing said surfaces being rigidly fixed to said housing, each surface defining a slurry flow path which begins adjacent one of said slots and passes to a separation point each of said surfaces bring configured such that the component of centrifugal force exerted on said slurry at said surface in a direction parallel to said surface will keep the slurry film flowing in a substantially laminar manner;

(e) means for rotating said housing;

(f) separation means positioned at said separation point to divide said slurry into heavy and light fractions;

(g) first-fraction discharge means for receiving and discharging said heavy fractions;

(h) second-fraction discharge means for receiving and discharging said light fraction;

(i) a stationary first-fraction collection chamber for collecting said heavy fraction; and (j) a stationary second-fraction collection chamber for collecting said light fraction.

16. A centrifugal separator as in claim 15, wherein said separation means comprises an adjustably mounted straight blade.

17. A cenrifugal separator as in claim 15, wherein said separation means comprises a pair of straight edges in each of said surfaces defining a slot in each of said surfaces.

18. A centrifugal separator as in claim 17, wherein said first-fraction discharge means comprises a screw conveyor behind each of said surfaces.

19. A centrifugal separator as in claim 18, wherein each of said screw conveyors is driven by a hydraulic motor, said hydraulic motors being connected in series by a fluid line which provides hydraulic fluid for driving said hydraulic motors.

20. A centrifugal separator as in claim 15, wherein said slurry forms a film with laminae of particles, the average density of particles in the laminae being progressively less as the lamina is displaced in a direction perpendicular to and away from the separating surface, and said separation means separates a first thin lamina containing particles of greater density from a remaining laminae containing particles of lesser density to form said first fraction and said second fraction, respectively.

* * * * *

UNITED STATES PATENT AND TRADEMARK OFFICE

CERTIFICATE OF CORRECTION

PATENT NO. : 4,479,790

DATED : October 30, 1984

INVENTOR(S) : Harry G. Bocckino, Jon P. Meyer

It is certified that error appears in the above-identified patent and that said Letters Patent are hereby corrected as shown below:

Column 9, lines 58-59, the equation should read as follows --

$$\theta = ctn\alpha_o - [(R^2 - sin^2\alpha_o)^{1/2}/sin\alpha_o] - \pi/2 + \alpha_o + cos^{-1}[(sin\alpha_o)/R]$$

Signed and Sealed this

Seventh Day of January 1986

[SEAL]

Attest:

DONALD J. QUIGG

Attesting Officer

Commissioner of Patents and Trademarks